US006024612A

United States Patent [19]

Myer et al.

[11] Patent Number: 6,024,612

[45] Date of Patent: Feb. 15, 2000

[54] RECEPTACLE CONTACT

[75] Inventors: John Mark Myer, Millersville; John Raymond Shuey, Mechanicsburg; Keith Robert Denlinger, Lancaster, all of Pa.

[73] Assignee: The Whitaker Corporation, Wilmington, Del.

[21] Appl. No.: 08/935,554

[22] Filed: Sep. 23, 1997

[51] Int. Cl.[7] ..... H01R 11/22

[52] U.S. Cl. ..... 439/852; 439/744

[58] Field of Search ..... 435/744, 745, 435/746, 839, 844, 845, 846, 847, 848, 851, 852, 855, 857

[56] References Cited

U.S. PATENT DOCUMENTS 4,880,401 11/1989 Shima et al. ..... 439/746
5,562,501 10/1996 Kinoshita et al. ..... 439/852

*Primary Examiner*—Lincoln Donovan

[57] ABSTRACT

An electrical contact (10) with a receptacle section (20) having a cantilever beam (32), which beam is spring biased by a spring (40). The location of the spring (40) is controlled by spring locking sections (46,47,48) formed thereon, and by complementary locking structures (26,27,28) of receptacle (20) which register with the spring locking sections (46,47,48).

19 Claims, 4 Drawing Sheets

RECEPTACLE CONTACT

BACKGROUND OF THE INVENTION

1. Field of the Invention

The present invention relates to electrical contacts, and, more particularly, to electrical contacts comprising a cantilever beam and a spring which biases against the cantilever beam. The present invention also relates to a method of making such electrical contacts.

2. Description of the Prior Art

Although most prior art receptacle electrical contacts or terminals are formed from a single member, some female contacts do employ a composite structure in which a separate spring member is used to provide the spring force for engaging a mating male contact or pin terminal. Typical female contacts employing such a composite structure include a spring member having different spring characteristics than the material forming the remainder of the female contact. For example, U.S. Pat. No. 4,880,401 discloses a contact with a stainless steel main body including a spring tab, and a separate contact piece formed from a material suitable for connection to a printed circuit board. U.S. Pat. No. 5,246,390 discloses another multicomponent receptacle contact with an and outer spring as part of an outer sleeve that can be fabricated prom a different material or can have a different material thickness from the inner receptacle.

Another approach in which a separate member is added to a stamped and formed receptacle contact is shown in U.S. Pat. No. 4,973,271 in which a reversely folded spring is backed up by a movable support member. The movable member is located on the exterior of the receptacle contact and can include a spring that engages the base of the folded spring and is not located between the two reversely formed portions of the primary spring.

The separate spring member shown in U.S. Pat. No. 4,973,271 is inserted axially onto the mating end of the receptacle contact. Since this separate spring member is located on the exterior of the folded primary spring, this separate spring can be axially inserted below the primary spring. Another approach to inserting a separate spring member into a receptacle body in shown in U.S. Pat. No. 5,441,428 where a spring member is inserted laterally into the receptacle body while the side walls are in a partially open position. The receptacle body is then formed around the spring, in an additional manufacturing step, with the top wall enclosing the opening through which the spring was initially inserted. A laterally extending tab on the spring fits within a window on the side of the receptacle body to hold the spring in place. U.S. Pat. No. 5,226,842 discloses a similar contact with lateral tabs located at one end of the spring and at the apex of the curved leaf spring. However, these latter patents employ the separate spring as the primary spring contact instead of as a back up spring such as that disclosed in U.S. Pat. No. 4,973,271.

These prior art receptacle contacts therefore employ either a separate spring as the primary spring or employ a backup spring with a primary spring having a relatively simple configuration.

SUMMARY OF THE INVENTION

The present invention provides a means for employing a back up spring, such as a stainless steel spring, with a cantilever beam that forms an extension of the contact receptacle section. The cantilever beam establishes electrical contact with a mating male or pin terminal that is inserted into the receptacle portion of the female contact. With the present invention, this additional spring can be inserted into the contact receptacle section without the need of additional manufacturing or forming operations. The additional spring is inserted laterally through an opening in the top side of the receptacle section. The cantilever beam extends from the rear of the spring receiving opening to the front of the receptacle section where the free end of the cantilever beam is supported by an overstress member which must be omitted if the spring were to be inserted axially through the front of the receptacle section. The spring is therefore positioned on top of the cantilever beam. The spring is held in position by tabs which fit within a window or aperture on side walls flanking the spring receiving opening. The tabs on the side edges of the spring are slanted or tapered back so that the tabs urge the side walls outward during insertion of the spring into the receptacle section. When the tabs enter the apertures the slanted or tapered configuration of these tabs engaged edges of the apertures to securely hold the spring in the receptacle section. The spring also has additional front and rear surfaces that also engage the side walls to position the spring in a canted configuration to support the cantilever beam when a pin, blade or other male terminal or contact is inserted into the female receptacle section. The front surface on the spring also engages an overstress member protruding inwardly from the wall section to prevent excessive deflection of the cantilever beam.

DETAILED DESCRIPTION OF THE INVENTION

Figure 1:
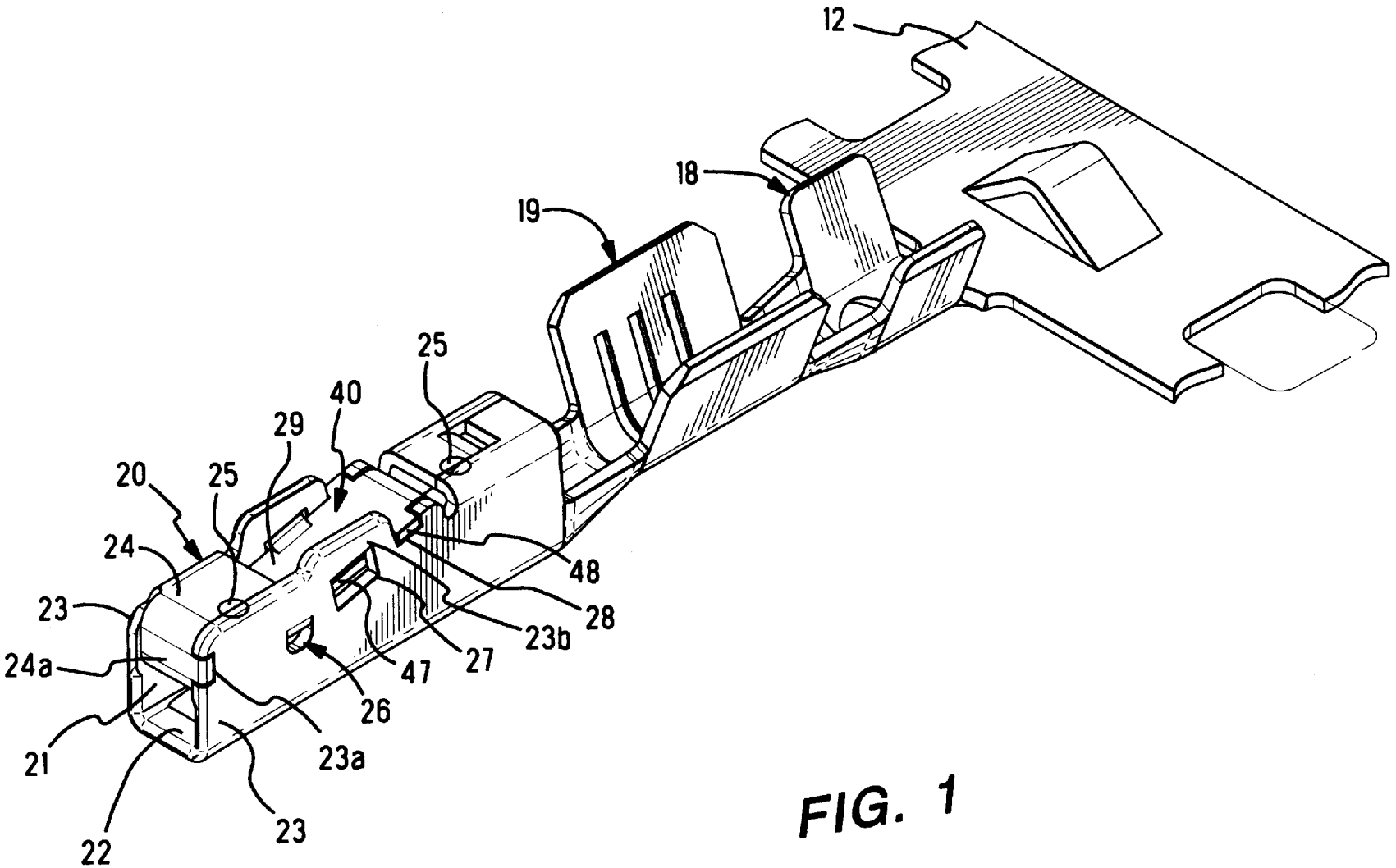
FIG. 1 is a front isometric view of the electrical contact according to the present invention.
Figure 2:
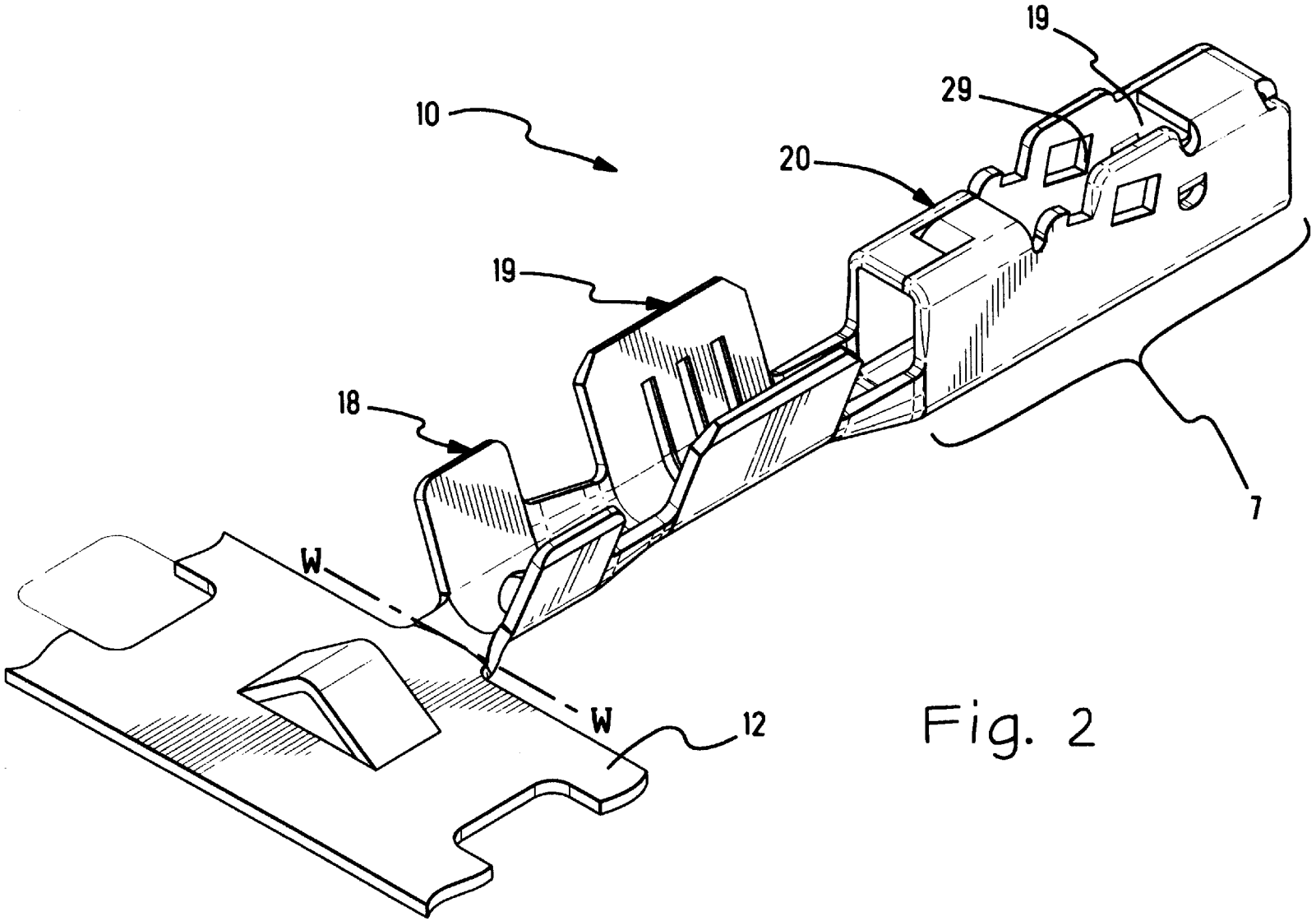
FIG. 2 is an isometric rear view of the contact of FIG. 1.
Figure 3:
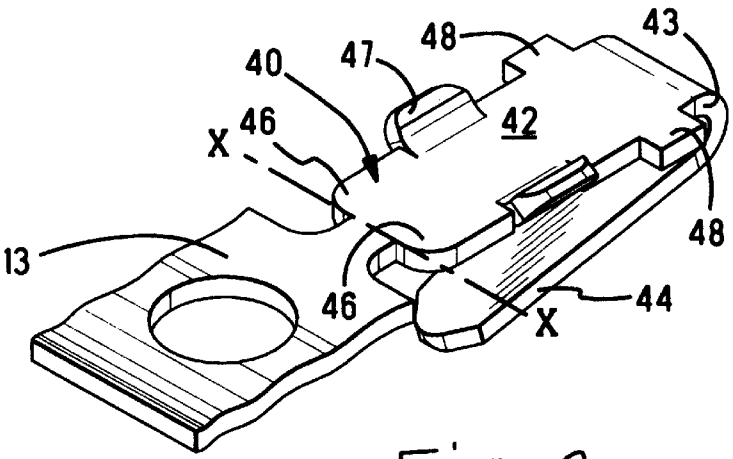
FIG. 3 is a spring used in the contact of FIG. 1.

Referring to FIGS. 1–3 and 5, an electrical contact 10 according to the present invention will be described. Contact 10 is connected to a carrier strip 12 as shown in FIGS. 1–3, but is to be severed therefrom along a shear line W—W shown in FIG. 2. Contact 10 comprises: a crimp barrel 18 for crimping to the insulation of a conductor; a conductor crimp barrel 19 for crimping to a conductor; a termination section or a receptacle section 20 for matingly receiving a further electrical contact therein; and a spring 40 located in a cavity 21 of receptacle section 20.

Figure 5:
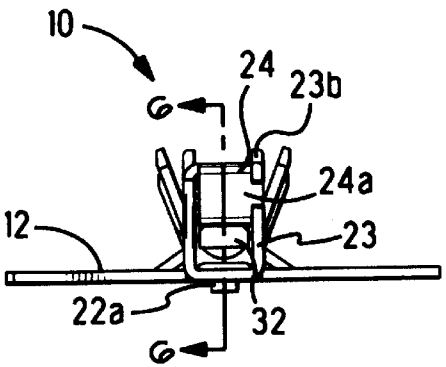
FIG. 5 is a front elevational view of the contact of FIG. 1.

Receptacle section 20 further includes bottom, side, and top walls 22,23,24, respectively. Welds 25 are strategically placed at two locations between walls 23 and 24 for joining the walls and imparting crush strength to receptacle section 20. As shown in FIGS. 1 and 5, the right-hand-side side wall 23 includes a recess 23*a* which receives a tab portion of an anti-stubbing plate 24*a* which extends from top wall 24, thereby providing additional crush strength to receptacle section 20.

As shown in FIG. 1, and also in FIG. 2 in which spring 40 has been removed for clarity, each side wall 23 includes wall locking sections comprising: an overstress member 26, relatively adjacent the front of the receptacle section 20, which projects into cavity 21; an aperture comprising a window 27 which receives a respective generally tapered or slanted locking projection 47 of spring 40 therein; and a recess 28, relatively adjacent the rear of the receptacle section 20, which receives a respective rear locking tab 48 of spring 40. An opening 29 is located between walls 23 adjacent to top wall 24 for receiving spring 40 therein, as will be described below. As best shown in FIGS. 1 and 5, receptacle section 20 comprises orientation features 22*a* and 23*b* which extend from walls 22, 23, respectively, which features act as guides during insertion of contact 10 into a cavity of an electrical connector housing, not shown in the drawings.

Spring 40, as shown in FIG. 3, is formed on a carrier strip 13, but is to be severed therefrom along a shear line X—X. Spring 40 is preferably formed of a high grade spring material having a low rate of springrate decay, e.g. a stainless steel material, and comprises a body section 42 from which a bend section 43 extends. Bend section 43 is a spring bend for providing resilient deflection capability to a spring beam 44 with which it is integrally formed so that the spring comprises a reversely formed member with body section 42 opposed to spring beam 44 on the opposite side of the intermediate bend section 43. The geometry and springrate of bend section 43 and beam 44 are purposefully selected to result in a calculated, controlled magnitude of contact normal force. Spring 40 also comprises locking members extending from body section 42, namely, locking sections 46, tapered or slanted locking projections 47, and rear locking tabs 48. The width of tapered or slanted locking projections 47 across body section 42 is sized to be larger than the width of opening 29, as measured generally transverse to a longitudinal axis of receptacle section 20, so that projections 47 will press on walls 23, as will be further described below.

Figure 6:
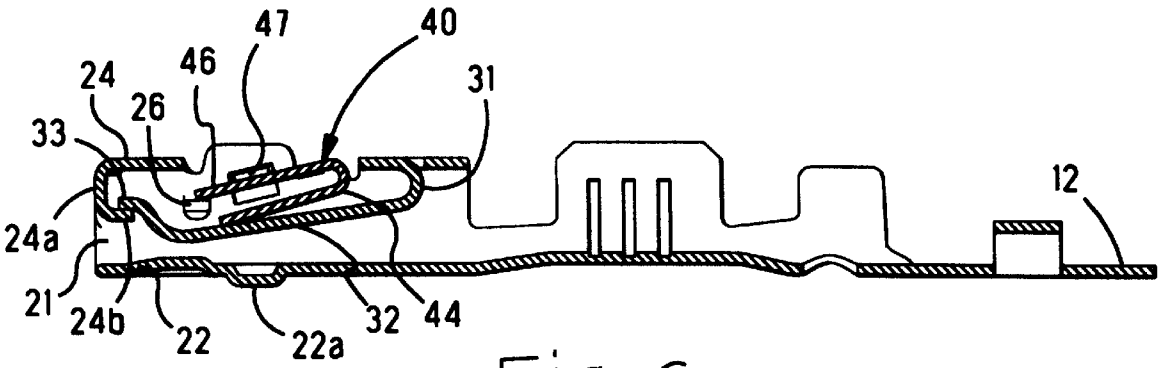
FIG. 6 is a cross sectional view of the contact of FIG. 1 taken along line 6—6 of FIG. 5.
Figure 7:
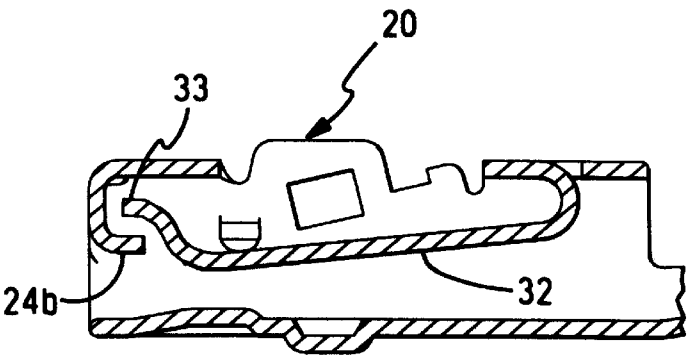
FIG. 7 shows a partial cross section of the contact of FIG. 2 taken along line 7—7.
Figure 4:
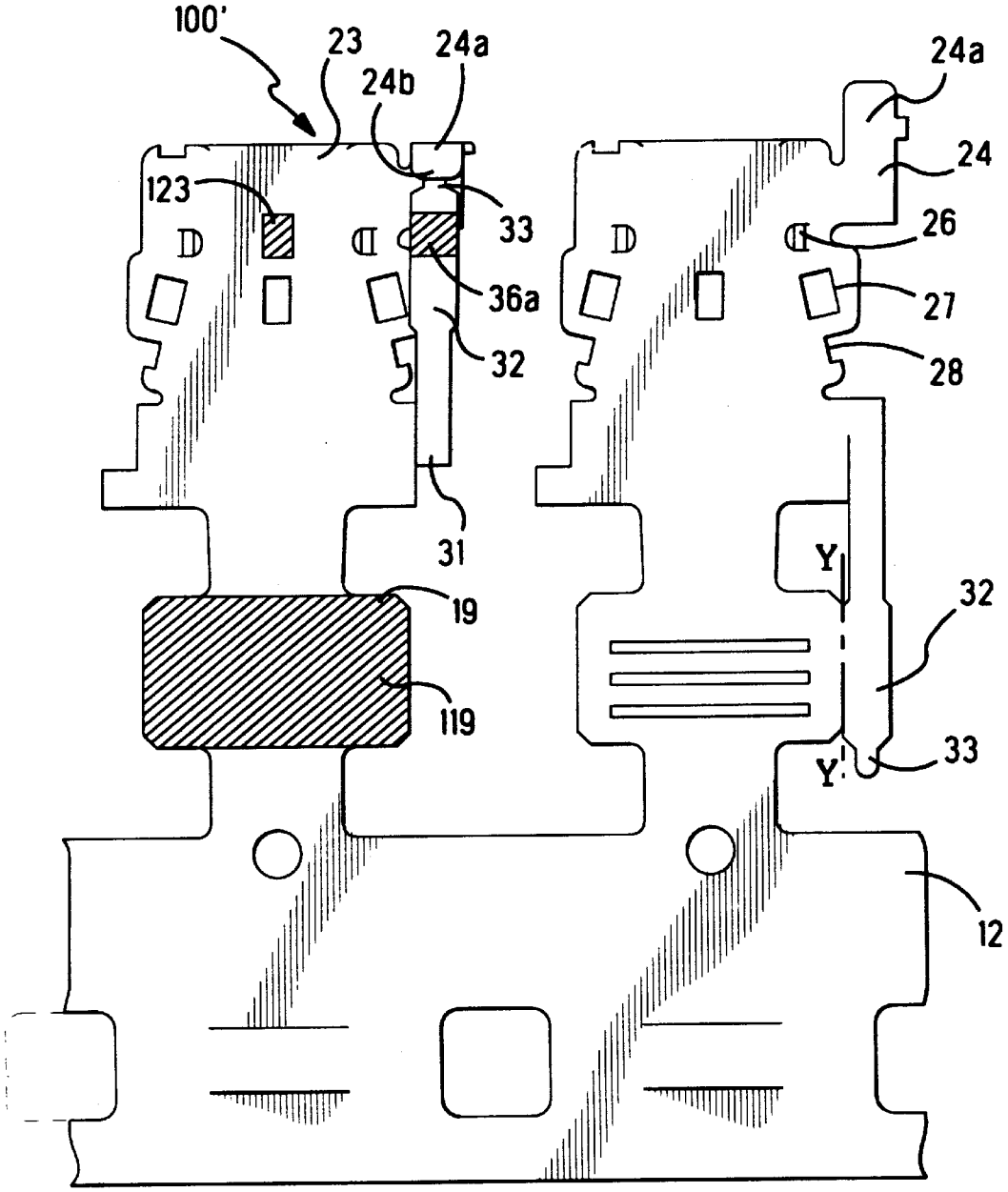
FIG. 4 is a plan view of profiles of stock material prior to formation into contacts according to the present invention.

Referring to FIGS. 4 and 6, formation and assembly of electrical contact 10 will be described. Contact 10 is formed of a stamped profile 100, as shown in FIG. 4, and is made of a low cost but highly conductive metal material, preferably phosphorous bronze. Profile 100 comprises the contours of top wall 24 with anti-stubbing plate 24*a*, overstress members 26, windows 27, and recesses 28. Additionally, profile 100 will be sheared along shear line Y—Y, thereby forming a strip of material. In the next formation step, the strip of material is bent into the form of a cantilever beam 32 having a free end 33, as shown by profile 100' of FIG. 4. Cantilever beam 32 includes a spring bend 31 for permitting resilient deflection of beam 32. Additionally, anti-stubbing plate 24*a* is bent to form an extension thereof comprising a retaining section 24*b* spaced from the free end 33 of beam 32, as shown in FIG. 7. Spacing free end 33 from retaining section 24*b* advantageously retains beam 32 without preloading it, i.e. since it is in a non-preloaded state no stresses inhere in beam 32 thereby avoiding unpredictable normal force contributions therefrom, as will be further described below. Beam 32 is also arranged to engage a wall locking section comprising overstress members 26. A suitable plating material, e.g. gold, is applied by a conventional plating process to specific areas comprising: area 36*a* of beam 32; area 123 of bottom wall 23; and area 119 of crimp barrel 19. Such plating enhances the conductivity of contact 10 bar lowering contact resistance.

The formation process of contact 10 further includes forming walls 23 and 24, thereby imparting a general box shape to receptacle section 20. However, an opening 29 will remain in top wall 24 between walls 23, as best shown in FIGS. 1–2. Next, spring 40 is inserted into opening 29 so that: locking sections 46 are aligned with respective overstress members 26; locking projections 47 are aligned with respective windows 27; and rear locking tabs 48 are aligned with respective recesses 28. As spring 40 is thus inserted, generally tapered or slanted locking projections 47 advantageously slidingly press on walls 23 thereby deflecting the walls against their inherent resilience, as the width of locking projections 47 is larger than the transverse width of opening 29, thereby enlarging opening 29. Tapered or slanted locking projections 47 slide on walls 23 until they snap into place in respective windows 27, at which time walls 23 resile back into a generally parallel position with respect to each other. Locking projections 47 are axially restrained but are loose in a top-to-bottom sense in respective windows 27. Locking projections 47 are generally biased toward an upper edge section of the windows, as best shown in FIGS. 1 and 6, by action of spring beam 44 pressing on cantilever beam 32. This is an assembly advantage because it assures that spring 40 is slightly stressed but locked in place in a generally canted orientation. When spring 40 is fully inserted in receptacle section 20, locking sections 46 come to rest adjacent respective overstress members 26, and rear locking tabs 48 are received in respective recesses 28.

FIG. 6 shows spring 40 fully assembled in receptacle section 20 such that three distinct areas of locking registration are made between spring 40 and receptacle section 20, namely: area A is defined by the locking registration of locking sections 46 with respective overstress members 26; area B is defined by the locking registration of locking projections 47 with respective windows 27; and area C is defined by the locking registration of rear locking tabs 48 with respective recesses 28. Areas of locking registration A,B,C place the spring in a controlled location, i.e. which removes uncertainty as to the location of spring 40 with respect to cantilever beam 32. The controlled location of spring 40 advantageously permits a precise calculation of the forces acting on a further electrical contact when it has been inserted in contact 10, as will be further described below. With spring 40 in this controlled position, welds 25 are effected to maintain it in place.

Prior to insertion of spring 40, free end 33 of cantilever beam 32 was spaced from retaining section 24*b*, thereby permitting cantilever beam 32 to be in a non-preloaded state, as shown in FIG. 7. When spring 40 is in the controlled position defined by areas A,B,C, spring beam 44 presses on and deflects cantilever beam 32, thereby eliminating any space between free end 33 and retaining section 24*b*.

Because the location and magnitude of normal force of spring 40 are controlled, and because cantilever beam 32 was in a non-preloaded state which eliminates unpredictable preloaded force contributions therefrom, the overall contact forces acting on a further contact inserted in contact 10 is advantageously calculated with a high degree of certainty and predictability. Such certainty and predictability permits a calculation of the spring loads acting on the further contact which will advantageously result in a minimizing of contact insertion forces and a maximizing of the longevity of the desired contact normal forces over the lifetime of the electrical connection of contact 10 with a further electrical contact. Moreover, use of stainless steel material in spring 40 will contribute to such longevity as the rate of decay of the spring-rate of stainless steel is relatively low.

Thus, while a preferred embodiment of the present invention has been disclosed, it is to be understood that that the invention is not strictly limited to such embodiment but may be otherwise variously embodied and practiced within the scope of the appended claims.

Accordingly, what is claimed is:

1. An electrical contact comprising:

(a) a receptacle section, said receptacle section comprises, opposed wall sections, and respective apertures formed in said opposed wall sections, said receptacle section including a cantilever beam between said opposed wall section, and a spring receiving opening facing one side of the receptacle section;

(b) a spring disposed in said receptacle section and insertable through said spring receiving opening behind said cantilever beam, said spring comprises locking sections for locking registration with respective said apertures;

(c) said locking sections being wider than opposed wall sections to press on said wall sections as said spring is inserted though said spring receiving opening, thereby deflecting the wall sections; and (d) said locking sections being received within said apertures so that said wall sections resile back to generally their original positions after the locking sections are snapped into respective said apertures.

2. The electrical contact of claim 1 wherein said locking sections comprise slanted tabs protruding from edges of said spring, said slanted tabs being slanted to deflect said wall sections as spring is inserted through said spring receiving opening.

3. The electrical contact of claim 2 wherein said slanted tabs are slanted to engage respective apertures to prevent withdrawal of said spring through said spring receiving opening.

4. The electrical contact of claim 3 wherein said wall sections include front and rear surfaces facing said one side of said spring receiving opening for engaging said spring in front of and to the rear of said slanted tabs to position said spring in said receptacle section.

5. The electrical contact of claim 4 wherein said front and rear surfaces are disposed to position said spring in a canted configuration in said receptacle section.

6. The electrical contact of claim 5 wherein said front surfaces comprises a tabs formed inwardly from said wall sections.

7. The electrical contact of claim 6 wherein said rear surfaces comprise recesses for receiving rear tabs on said spring.

8. The electrical contact of claim 1 wherein said spring comprises a reversely bent member having a beam joined to a body by a bend section.

9. The electrical contact of claim 1 wherein said spring comprises a stainless steel spring.

10. The electrical contact of claim 8 wherein said locking sections are located on said spring body section with said beam section being free to deflect relative to said wall sections.

11. The electrical contact of claim 1 wherein said receptacle section comprises a deflectable cantilever beam, said spring being located between said opening and said cantilever beam with said spring section engaging said cantilever beam so that deflection of said cantilever beam also requires deflection of said spring.

12. The electrical contact of claim 11 wherein said cantilever beam comprises an extension of said receptacle section, and said spring if formed from a material having different spring characteristics than the material from which said cantilever beam is formed.

13. The electrical contact of claim 11 wherein a free end of said cantilever beam is located adjacent to the front of said receptacle section, said receptacle section including a retaining section engaging the free end of said cantilever beam when said cantilever beam is undeflected.

14. The electrical contact of claim 11 wherein at least one of said wall sections includes an overstress member, said cantilever beam engaging said overstress member to prevent excessive deflection of said cantilever beam, said overstress member also engaging said spring to position said spring in said receptacle section.

15. An electrical contact comprising:

(a) a receptacle section, said receptacle section comprises a spring receiving opening between opposed wall sections;

(b) said opposed wall sections each comprise respective first, second, and third wall locking sections for receiving respective portions of a spring;

(c) a spring disposed in said receptacle section, said spring having complementary first, second, and third spring locking sections on opposed edges of said spring which register with respective first, second and third wall locking sections for positioning the spring in said receptacle section adjacent said spring receiving opening.

16. The electrical contact of claim 15, wherein said receptacle section comprises a cantilever beam therein, overstress of said cantilever beam being prevented by one of said wall locking sections.

17. The electrical contact of claim 15, wherein one of said wall locking sections comprises an edge section, and said one of said spring locking sections is biased against said edge section.

18. The electrical contact of claim 15, wherein said spring is located at a canted orientation relative to said receptacle section by registration between said wall locking sections and said spring locking sections.

19. An electrical contact comprising:

(a) a receptacle section, said receptacle section comprises, opposed wall sections, and respective apertures formed in said opposed wall sections, and a spring receiving opening facing one side of the receptacle section;

(b) a spring disposed in said receptacle section and insertable through said spring receiving opening, said spring comprises locking sections for locking registration with respective said apertures, said spring being deflectable when a mating electrical contact is inserted into said receptacle section;

(c) said locking sections being wider than opposed wall sections to press on said wall sections as said spring is inserted though said spring receiving opening, thereby deflecting the wall sections; and (d) said locking sections being received within said so that said wall sections resile back to generally their original positions after the locking sections are snapped into respective said apertures.

* * * * *